US006105320A

United States Patent [19]

Boor et al.

[11] Patent Number: 6,105,320

[45] Date of Patent: Aug. 22, 2000

[54] SHIP'S WINDOW

[75] Inventors: Gijsbert W. Boor, Hilversum; Alan Bekendam, Almere, both of Netherlands

[73] Assignee: Boomsma Produktie BV, Almere-Haven, Netherlands

[21] Appl. No.: 09/101,855

[22] PCT Filed: Jan. 20, 1997

[86] PCT No.: PCT/NL97/00016

§ 371 Date: Nov. 24, 1998

§ 102(e) Date: Nov. 24, 1998

[87] PCT Pub. No.: WO97/26179

PCT Pub. Date: Jul. 24, 1997

[30] Foreign Application Priority Data

Jan. 19, 1996 [NL] Netherlands ..... 1002128

[51] Int. Cl.[7] ..... E06B 3/00

[52] U.S. Cl. ..... 52/204.72; 52/204.597; 52/208; 52/656.5

[58] Field of Search ..... 52/204.72, 204.71, 52/204.597, 208, 204.591, 656.5, 205, 206

[56] References Cited

U.S. PATENT DOCUMENTS

| | | | |
|---|---|---|---|
| 3,903,669 | 9/1975 | Pease, Jr. et al. | 52/208 X |
| 4,418,506 | 12/1983 | Weber et al. | 52/204.597 X |
| 5,546,714 | 8/1996 | Kenkel | 52/204.71 X |
| 5,577,355 | 11/1996 | Leonelli | 52/204.597 X |
| 5,636,484 | 6/1997 | DeBlock | 52/204.72 X |

FOREIGN PATENT DOCUMENTS

| | | | |
|---|---|---|---|
| 25 39 363 | 3/1976 | Germany . | |
| 88 10 801 U | 10/1988 | Germany . | |
| 461 758 | 10/1968 | Switzerland . | |
| 2 170 255 | 7/1986 | United Kingdom . | |
| 2197903 | 11/1988 | United Kingdom | 52/204.71 |
| 4628 648 | 12/1986 | WIPO . | |

*Primary Examiner*—Beth A. Stephan
*Assistant Examiner*—Brian E. Glessner
*Attorney, Agent, or Firm*—Jeffrey D. Myers; Joseph Barrera

[57] ABSTRACT

A ship's window with inner and outer profiles that is clamped to the sides of an opening in the ship. The window contains insulators between the outer profile and the outer side of the ship, the glazing, and the inner profile.

3 Claims, 2 Drawing Sheets

SHIP'S WINDOW

CROSS REFERENCE TO RELATED APPLICATIONS

This application claims the benefit of the filing of Patent Cooperation Treaty Application Ser. No. NL97/00016 entitled "Ship's Window", to Boomsma Produktie B. V., filed on Jan. 20, 1997, and the specification thereof is incorporated herein by reference.

BACKGROUND OF THE INVENTION

1. Field of the Invention (Technical Field)

The present invention relates to a ship's window which comprises glazing, a holder for the glazing and means for setting the window into a ship's side.

2. Background Art

Such a window is known from CH-A-461.758. For some considerable time now a need exists for a ship's window with insulating properties, to be used, for instance, with sailing boats and motor yachts. The object of the invention is to provide such a ship's window while at the same time attaining further advantages which will be explained below.

SUMMARY OF THE INVENTION (DISCLOSURE OF THE INVENTION)

The ship's window according to the invention comprises clamping means for fastening the window in the ship's side, the clamping means being provided for a part by the outer profile. When mounted, this means that between the outer profile and the ship's side an insulation profile is placed. By conferring on the outer profile the additional function of fastening the window in the ship's side, a very neat finish is achieved on the outside, while at the -same time making it burglar-resistant because in this embodiment no external connective means are exposed. It is also desirable that the clamping means comprise a clamping strip which, when mounted, is joined to the inner profile and is then clamped to the side of the ship's side which is opposite to the outer profile. In this way the ship's window of the invention can simply be set at the last into an otherwise finished ship's side without requiring any dirt-producing work such as drilling holes.

An advantageous embodiment of the ship's window according to the invention is characterized, in that the insulation means between the inner profile and the outer profile is formed by at least an insulating distance piece, and in that on both sides of the glazing insulation profiles are provided, whose sides facing away from the glazing abut against the inner profile and outer profile respectively, which inner and outer profiles fix the insulation profiles to the glazing.

The invention effectively prevents the formation of thermal bridges between the inner profile, the outer profile and the glazing. With this in view, it is essential to use the insulating distance piece between the inner profile and the outer profile, whereby thermal separation between the environments prevailing inside and outside the ship's side, is maintained.

There are various ways for fixing this distance piece between the inner profile and the outer profile, such as by gluing or by screwing. When using screws, separate screw connections have to be provided for fastening the distance piece to the inner profile and outer profile respectively.

Identical reference numbers refer to identical parts.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1:
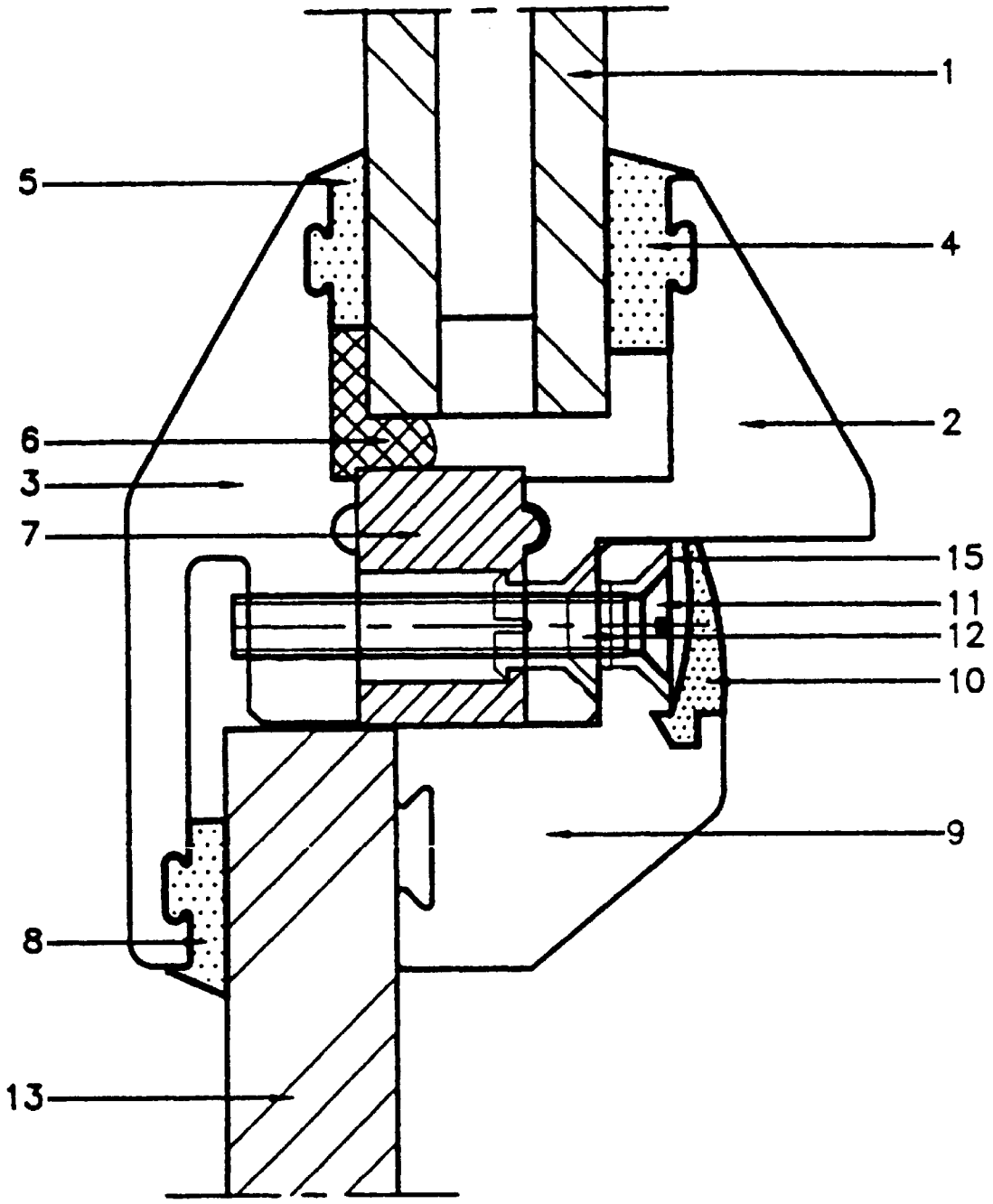
FIG. 1 shows a first embodiment of a ship's window according to the invention in mounted condition.
Figure 2:
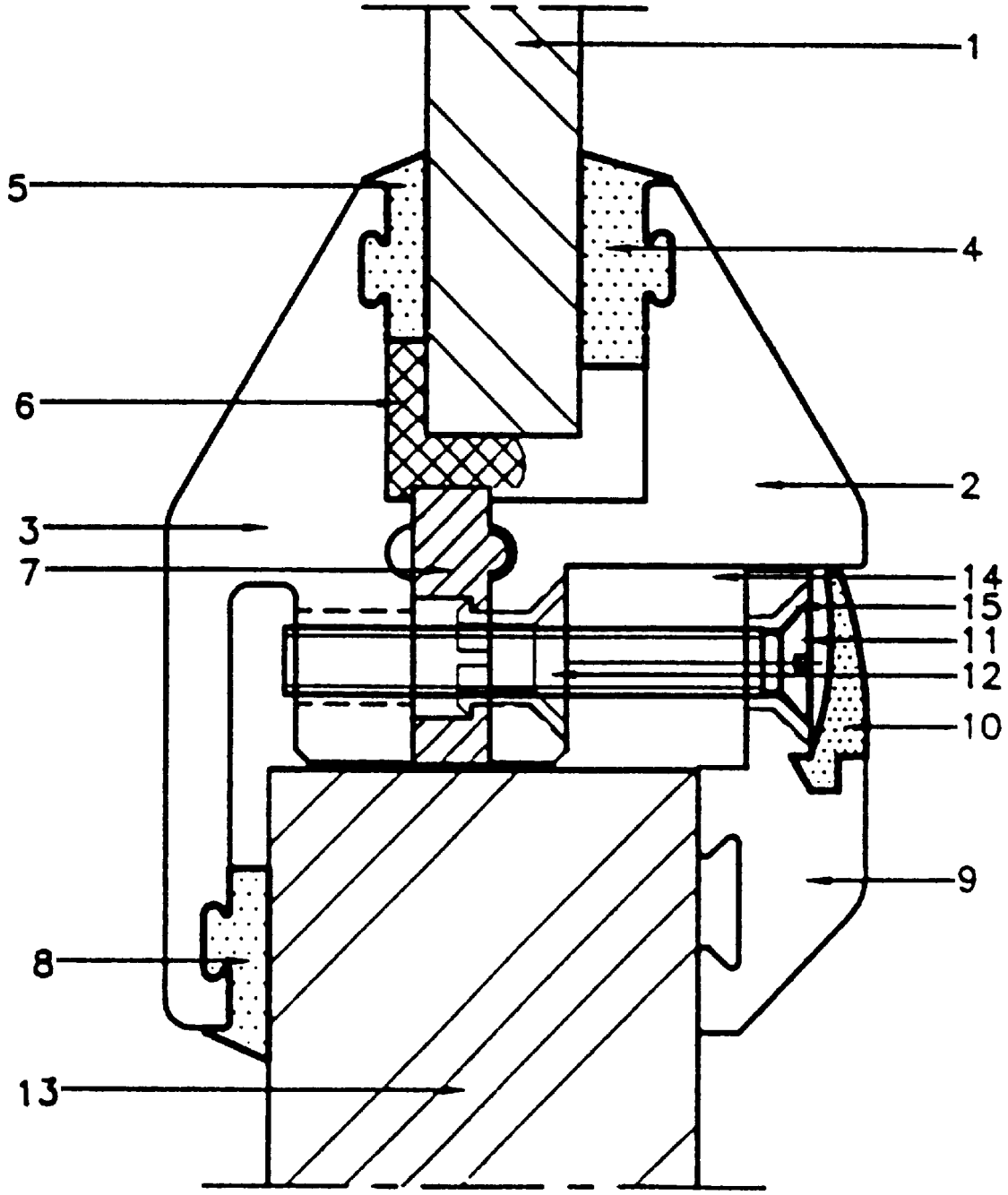
FIG. 2 shows a second embodiment of a ship's window according to the invention in mounted condition.

Both FIG. 1 and FIG. 2 show a ship's window comprising a glazing 1 and a holder for the glazing consisting of an inner profile 2 and an outer profile 3. The glazing 1 is clamped between the inner profile 2 and outer profile 3, preventing the formation of thermal bridges by means of insulation profiles 4 and 5 between the inner profile 2 and the glazing, respectively the outer profile 3 and the glazing 1. The insulation profiles 4 and 5 are, for instance, rubber profiles. In addition, a sealing silicon paste 6 is provided at the side of the outer profile 3, to ensure the watertightness of the window construction.

The embodiments shown in FIG. 1 and FIG. 2 differ from each other in that FIG. 1 shows an embodiment with a relatively thin ship's side 13 and double glazing 1 and FIG. 2 shows an embodiment with a relatively thick ship's side 13 and a single, relatively thick thermically insulating glazing 1. By adjusting both the dimensions of the distance piece 7 and the clamp strip 9, which strip will be discussed below, it is very simple to provide for the mutual adjustment of a great variety of dimensions of the ship's side 13 and the glazing 1. The ship's window may for a large part be prepared before being set into the ship's side 13 because the inner profile, the outer profile and the intermediate insulation profiles 4 and 5 as well as the distance piece 7 may be mounted beforehand. The distance piece 7 may, for instance, be fixed onto the inner profile 2 and the outer profile 3 by means of a snap-in connection, however here the use of screws is shown. For the fastening of the inner profile 2 onto the distance piece 7, and of the distance piece 7 onto the outer profile 3, separate screw connections are applied. A construction for the simultaneous mutual screw fastening of the outer profile 3, and the inner profile 2 with in between the distance piece 7 is also possible.

At the inner ship's side 13 the window is fastened by using clamp means 3, 9 while the clamp means at the external ship's side 13 are provided by the outer profile 3. Between this outer profile 3 and the ship's side 13 an insulation profile 8 is provided, for instance made of rubber. At the inner ship's side 13, fastening is effectuated by using a clamp strip 9, while in order to optionally adapt to the thickness of the ship's side 13, an intermediate piece 14 may be applied (see FIG. 2). The clamp strip 9 is connected to the outer profile 3 by means of a screw connection 11, with an insulator 15 being provided between the screw head and the clamp strip 9.

The construction of the ship's window according to the invention avoids the necessity of drilling into the ship's side 13. The ship's window can therefore be set simply and cleanly into an otherwise finished ship's side. To further improve the visual effect, a finishing lip 10 may be provided which may, for instance, also be made of rubber.

It will be clear to the expert that the invention must not be understood to be limited to the two embodiments discussed, and that many variations are possible in dimensions of ship's sides and glazing within the scope of the invention as specified in the accompanying claims.

What is claimed is:

1. In combination with a ship, a ship's window which comprises glazing, a holder for the glazing wherein the holder for the glazing comprises an inner profile and an outer profile with the glazing being secured between said outer and inner profiles and said outer and inner profiles are thermically separated from each other and from the glazing by interpositioned insulation means, and a clamping strip for clamping said window in the ship's side, such that a single means for fastening secures said glazing between said outer and inner profiles and clamps said window to the side of the ship, wherein said single means for fastening contacts said inner profile, said outer profile, and said clamping strip.

2. A ship's window according to claim 1, characterized in that the insulation means between the inner profile and the outer profile is formed by at least an insulating distance piece, and in that on both sides of the glazing insulation profiles are provided, whose sides facing away from the glazing abut against the inner profile and outer profile respectively, which inner and outer profiles fix the insulation profiles to the glazing.

3. A ship's window according to claim 1 further comprising an interpositioned insulation means between said outer profile and the ship's side when said ship's window is clamped to the side of the ship.

* * * * *